US007185582B2

(12) United States Patent
Inoue et al.

(10) Patent No.: US 7,185,582 B2
(45) Date of Patent: Mar. 6, 2007

(54) OILLESS RECIPROCATING FLUID MACHINE

(75) Inventors: Hiroshi Inoue, Yokohama (JP); Toshio Iida, Yokohama (JP)

(73) Assignee: Anest Iwata Corporation (JP)

( * ) Notice: Subject to any disclaimer, the term of this patent is extended or adjusted under 35 U.S.C. 154(b) by 59 days.

(21) Appl. No.: 10/968,210

(22) Filed: Oct. 19, 2004

(65) Prior Publication Data

US 2005/0092174 A1 May 5, 2005

(30) Foreign Application Priority Data

Oct. 31, 2003 (JP) ..... 2003-373561

(51) Int. Cl.
*F16J 1/04* (2006.01)

(52) U.S. Cl. ..... 92/212

(58) Field of Classification Search ..... 92/212
See application file for complete search history.

(56) References Cited

U.S. PATENT DOCUMENTS 5,117,742 A * 6/1992 Iida ..... 92/212
5,948,330 A * 9/1999 Rivers et al. ..... 92/212

* cited by examiner

*Primary Examiner*—F. Daniel Lopez
(74) *Attorney, Agent, or Firm*—McKee, Voorhees & Sease, P.L.C.

(57) ABSTRACT

An oilless reciprocating fluid machine has a piston mounted to a connecting rod by inserting a piston pin in a pin bore of a cylinder. The piston is reciprocally moved up and down in the cylinder with reciprocating of the connecting rod. A reinforcement plate is embedded in the top wall of the piston or attached on the lower surface of the top wall to increase strength of the piston. The reinforcement plate may be formed in various shapes.

2 Claims, 10 Drawing Sheets

PRIOR ART

OILLESS RECIPROCATING FLUID MACHINE

BACKGROUND OF THE INVENTION

The present invention relates to an oilless reciprocating fluid machine in which fluid is compressed or decompressed by reciprocating a piston in a cylinder through a crank rod and a piston pin.

FIG. 25 shows a conventional oilless reciprocating fluid machine. In an Al alloy cylinder 51 having cooling fins 50 on the outer circumference, a self-lubricating synthetic resin piston 57 is slidably fitted. The piston 57 has a self-lubricating piston ring 52 on the outer circumference. A piston pin 56 is fixed in an annular portion 55 of a connecting rod 54 which can be reciprocated by power (not shown), and the ends of the piston pin 56 are supported in a pair of radial pin bores 53,53 of a middle portion.

The piston 57 is made of self-lubricating resin composites in which heat resistant material for increasing slidability such as graphite is mixed with strength-increasing material such as carbon fiber.

The piston made of self-lubricating and heat resistant synthetic resin avoids fouling or seizure to keep a long-time operation thereafter even if the outer circumference of the piston is directly engaged with the inner surface of the cylinder owing to wear of the piston ring during a long-time operation.

However, synthetic resin piston has strength about a half or a quarter less than Al alloy piston. To bear operational pressure equal to that applied to a fluid machine that comprises an Al alloy piston, it is necessary to provide thickness of a top wall of a piston with two to four times more than Al alloy.

Specifically, when the top wall of an Al alloy piston having an external diameter of 100 mm, length of 80 mm and thickness of a middle portion of about 9 mm is about 7 mm thick, the top wall of synthetic resin piston having the same external diameter needs to be about 14 to 28 mm thick.

In the piston having much thicker top wall than the conventional piston, the following disadvantages are likely to occur.

During molding, defects such as cavities and nonuniforms are involved within the top wall to decrease strength. The longer the distance between a pin bore and the top of the piston is, the more oscillation during reciprocation of the piston occurs, thereby increasing wear of a piston ring and hitting the piston against the inner surface of the cylinder for a relatively short time to cause higher sound in operation.

To prevent such oscillation, it is necessary to extend the distance between the pin bore and the lower end of the piston in coincidence with increased distance between the pin bore and the top of the piston, but the whole height of the piston is increased, so that weight and cost are increased.

Thus, without increasing thickness of the top wall of the synthetic resin piston, it is necessary to attain strength of the top wall enough to withstand pressure applied to the inside of the cylinder.

SUMMARY OF THE INVENTION

In view of the disadvantages in the prior art, an object of the invention is to provide an oilless reciprocating fluid machine comprising a piston that provides high strength of the top wall without changing thickness.

BRIEF DESCRIPTION OF THE DRAWINGS

The foregoing and other features and advantages of the invention will become more apparent from the following description with respect to embodiments as shown in appended drawings wherein.

DETAILED DESCRIPTION OF PREFERRED EMBODIMENTS

Figure 1:
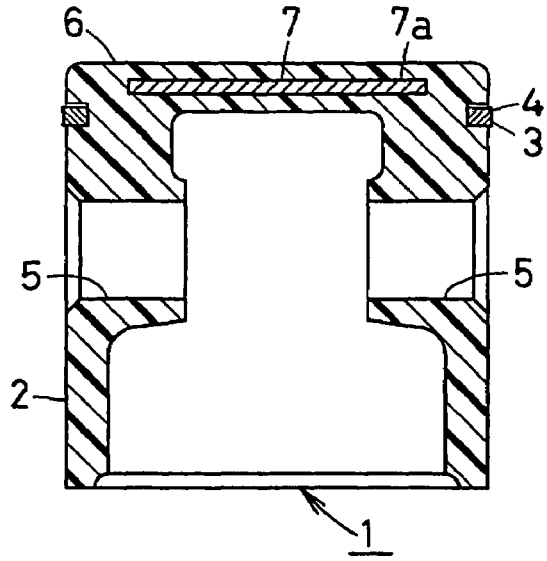
FIG. 1 is a vertical sectional front view of the first embodiment of an oilless reciprocating fluid machine according to the present invention.

FIG. 1 shows the first embodiment of the present invention. A piston 1 made of self-lubricant and heat-resistant synthetic resin has in the vicinity of the upper end a circumferential groove 4 in which a piston ring 3 made of self-lubricant material is engaged, and in a middle portion 2, pin bores 5,5 face each other radially.

In a top wall 6 of the piston 1, a flat disc-like reinforcement plate 7 made of iron, stainless steel, Ti or other metals, carbon-fiber-containing resin or other resins that have higher strength than the piston 1 or ceramics is embedded-such that a circumferential portion 7*a* is positioned above the middle portion 2. The circumferential portion 7*a* of the reinforcement plate 7 need not to reach above the middle portion 2.

In FIGS. 2 to 25, the same numerals are allotted to the same parts as those in FIG. 1, and only differences will be described.

Figure 2:
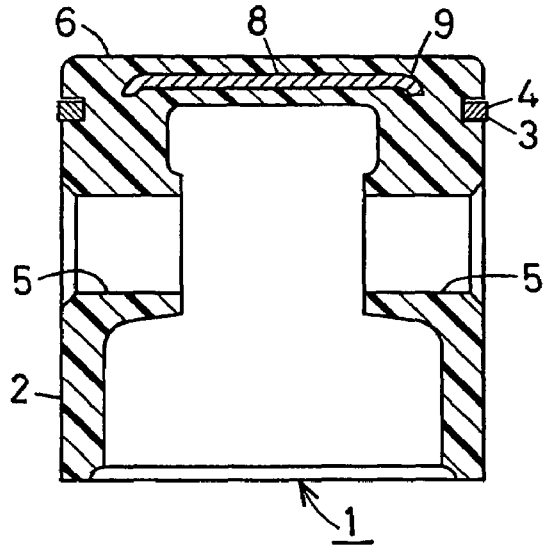
FIG. 2 is a vertical sectional front view of the second embodiment of an oilless reciprocating fluid machine according to the present invention.

FIG. 2 shows the second embodiment of the present invention. A reinforcement plate 8 embedded in a top wall 6 of a piston 1 has a downward-curving flange 9 at the circumference.

Figure 3:
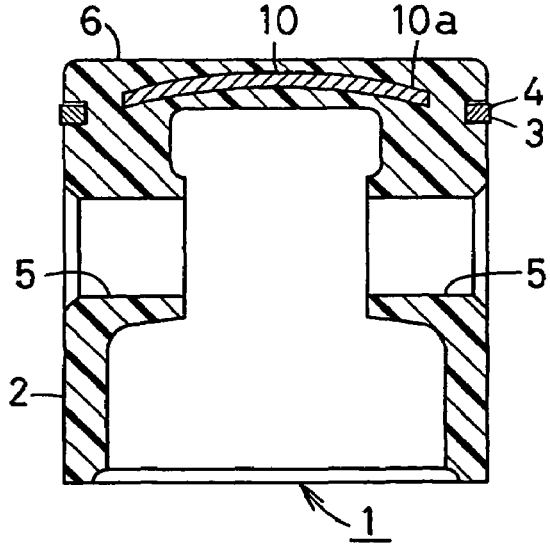
FIG. 3 is a vertical sectional front view of the third embodiment of an oilless reciprocating fluid machine according to the present invention.

FIG. 3 shows the third embodiment of the present invention. A reinforcement plate 10 has a circumferential portion 10*a* above a middle portion 2 of a piston 1 and is convex.

Figure 4:
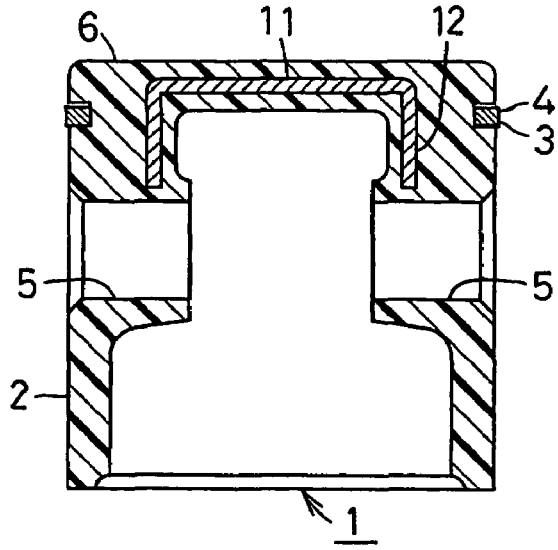
FIG. 4 is a vertical sectional front view of the fourth embodiment of an oilless reciprocating fluid machine according to the present invention.

FIG. 4 shows the fourth embodiment of the present invention. A reinforcement plate 11 has a reinforcement tube 12 which protrudes downward in a middle portion 2 of a piston 1.

Figure 5:
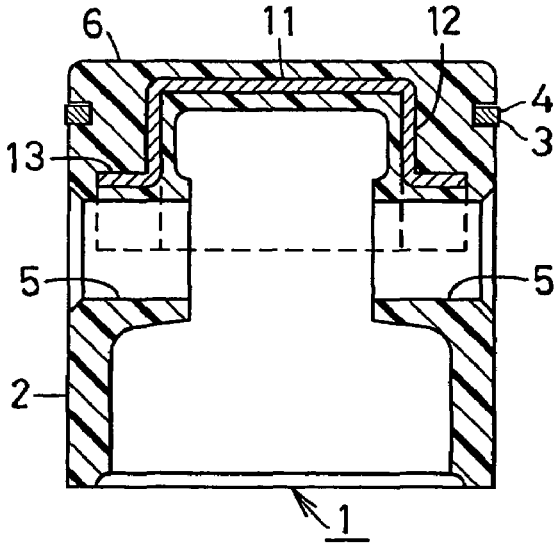
FIG. 5 is a vertical sectional front view of the fifth embodiment of an oilless reciprocating fluid machine according to the present invention.

FIG. 5 shows the fifth embodiment of the present invention. A reinforcement plate 11 has a reinforcement tube 12 which has a semicylindrical support portion 13 at the lower end. The support portion 13 surrounds an upper half of a pin bore 5 of a middle portion 2 of a piston 1.

Figure 6:
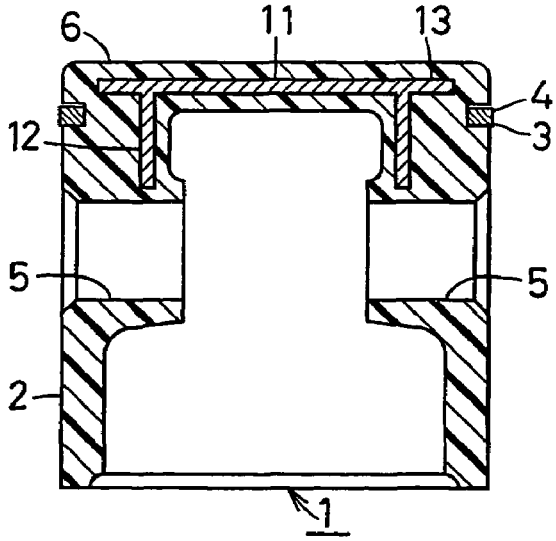
FIG. 6 is a vertical sectional front view of the sixth embodiment of an oilless reciprocating fluid machine according to the present invention.

FIG. 6 shows the sixth embodiment of the present invention. A reinforcement plate 11 has a circumferential portion 13 which protrudes horizontally from a reinforcement tube 12.

Figure 7:
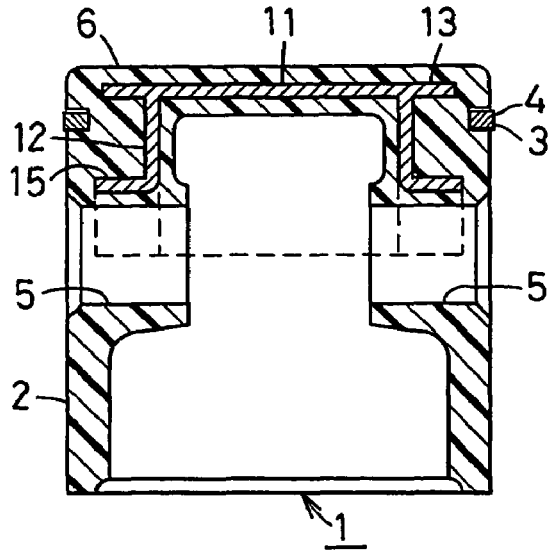
FIG. 7 is a vertical sectional front view of the seventh embodiment of an oilless reciprocating fluid machine according to the present invention.

FIG. 7 shows the seventh embodiment of the present invention. At the lower end of a reinforcement tube 12, a semicylindrical support portion 15 is provided over the upper half of a pin bore 5 of a middle portion 2.

Figure 8:
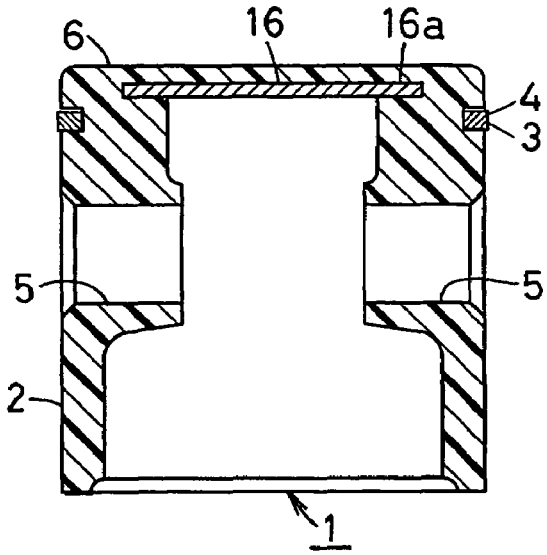
FIG. 8 is a vertical sectional front view of the eighth embodiment of an oilless reciprocating fluid machine according to the present invention.

FIG. 8 shows the eighth embodiment of the present invention. A reinforcement plate 16 is attached on the lower surface of a top wall 6 and the outer circumference of the reinforcement plate 15 reaches above a middle portion 2. The reinforcement plate 16 is integrally molded with a piston 1.

Figure 9:
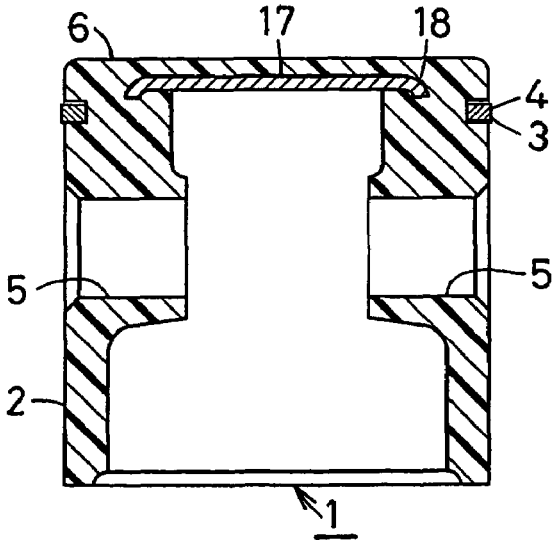
FIG. 9 is a vertical sectional front view of the ninth embodiment of an oilless reciprocating fluid machine according to the present invention.

FIG. 9 shows the ninth embodiment of the present invention. The circumference of a reinforcement plate 17 is bent downward to form a flange 18.

Figure 10:
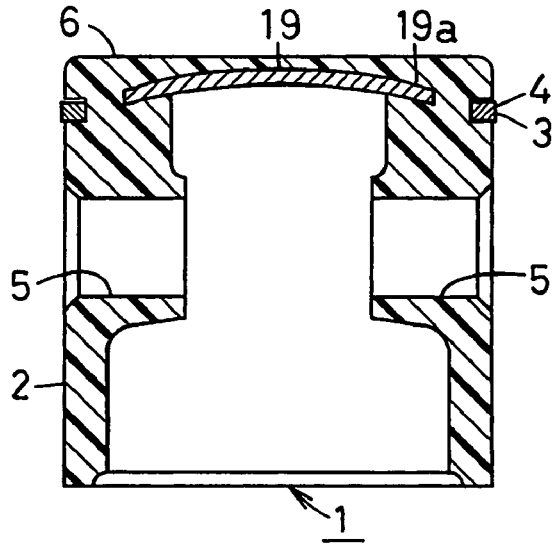
FIG. 10 is a vertical sectional front view of the tenth embodiment of an oilless reciprocating fluid machine according to the present invention.

FIG. 10 shows the tenth embodiment of the present invention. A convex reinforcement plate 19 is attached to the lower surface of a top wall 76 of a piston 1 and reaches above a middle portion 2 of a piston 1.

Figure 11:
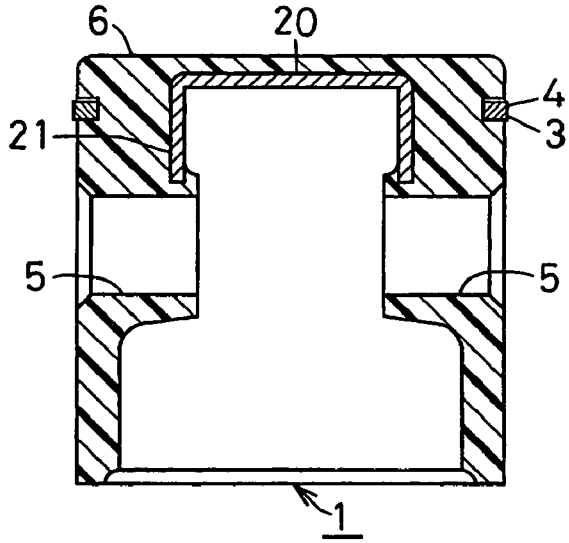
FIG. 11 is a vertical sectional front view of the eleventh embodiment of an oilless reciprocating fluid machine according to the present invention.

FIG. 11 shows the eleventh embodiment of the present invention. The circumference of a reinforcement plate 20 has a reinforcement tube 21 which projects toward a middle portion 2 of a piston 1. The inner surface of the reinforcement tube 21 is exposed from the inner surface of the middle portion 2.

Figure 12:
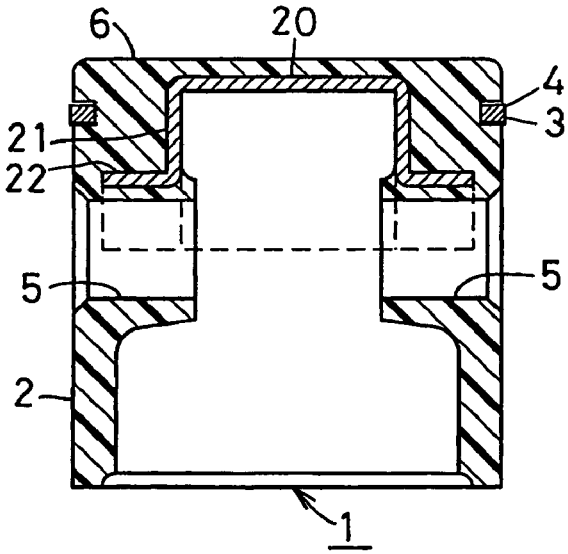
FIG. 12 is a vertical sectional front view of the twelfth embodiment of an oilless reciprocating fluid machine according to the present invention.

FIG. 12 shows the twelfth embodiment of the present invention. At the lower end of reinforcement tube 21, a semicylindrical support portion 22 is provided to surround an upper half of a middle portion 2.

Figure 13:
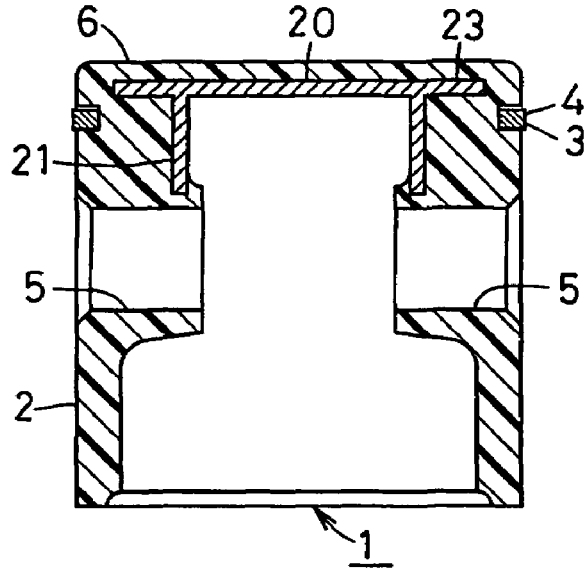
FIG. 13 is a vertical sectional front view of the thirteenth embodiment of an oilless reciprocating fluid machine according to the present invention.

FIG. 13 shows the thirteenth embodiment of the present invention. A circumferential portion 23 of a reinforcement plate 20 protrudes horizontally from a reinforcement tube 21.

Figure 14:
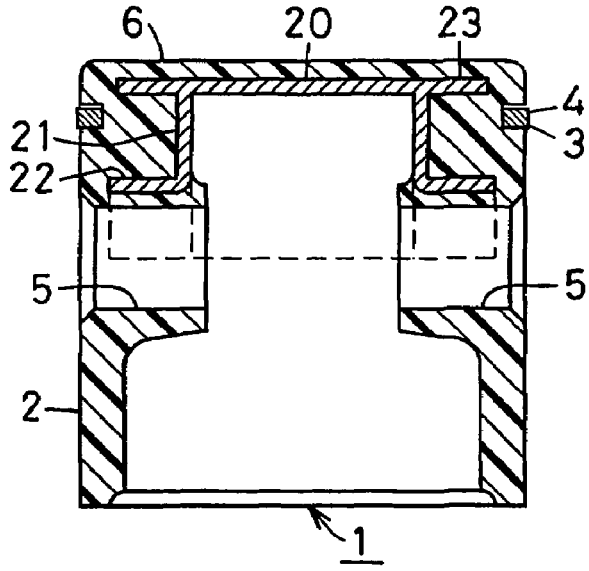
FIG. 14 is a vertical sectional front view of the fourteenth embodiment of an oilless reciprocating fluid machine according to the present invention.

FIG. 14 shows the fourteenth embodiment of the present invention. A circumferential portion 23 of a reinforcement plate 20 protrudes from a reinforcement tube 21, and a semicylindrical support portion 22 extends horizontally from the lower end of the reinforcement tube 21 to surround an upper half of a pin bore 5.

Figure 15:
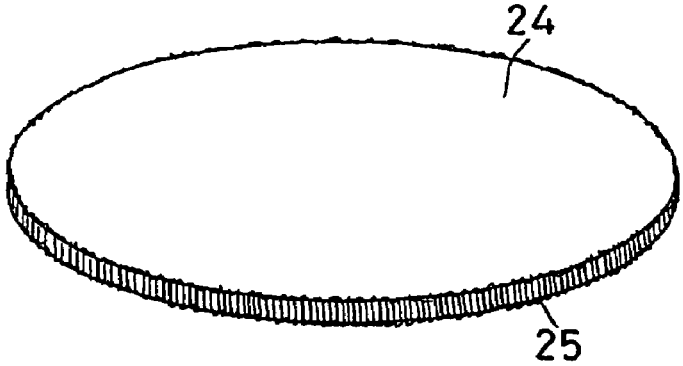
FIG. 15 is a perspective view of a reinforcement plate in which a number of irregularities are formed on its outer circumference.

FIG. 15 shows a reinforcement plate 24 in which a number irreguralities 25 are formed on its outer circumference.

Figure 16:
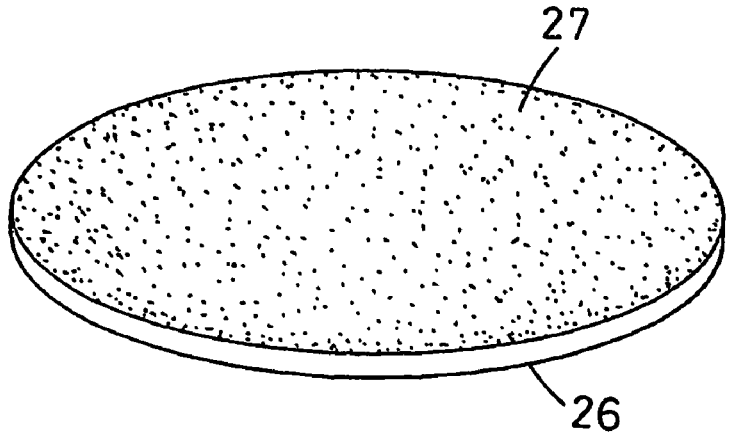
FIG. 16 is a perspective view of a reinforcement plate having an upper rough surface.

FIG. 16 shows a reinforcement plate 26 which has an upper rough surface 27.

Figure 17:
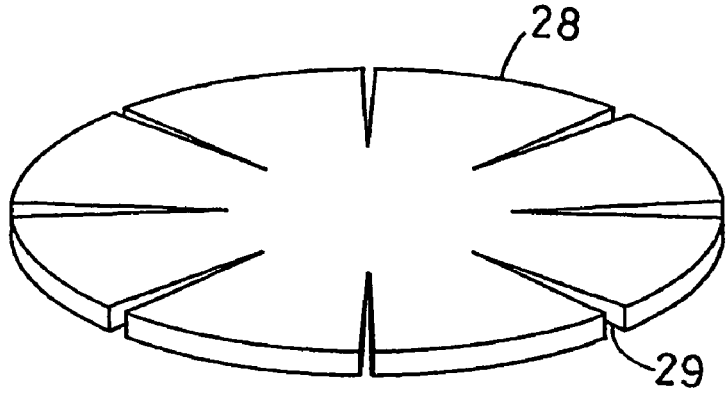
FIG. 17 is a perspective view of a rough reinforcement plate in which a number of slits extends radially from the outer circumference.

FIG. 17 shows a reinforcement plate 28 in which a number of redial slits 29 extend from its outer circumference toward the center.

Figure 18:
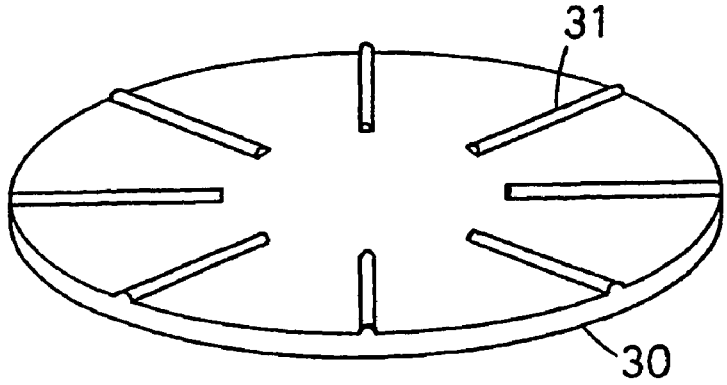
FIG. 18 is a perspective view of a reinforcement plate in which a number of protrusions extends radially from the outer circumference.

FIG. 18 shows a reinforcement plate 30 in which a number of radial protrusions 31 extend from its outer circumference toward the center on the upper surface.

Figure 19:
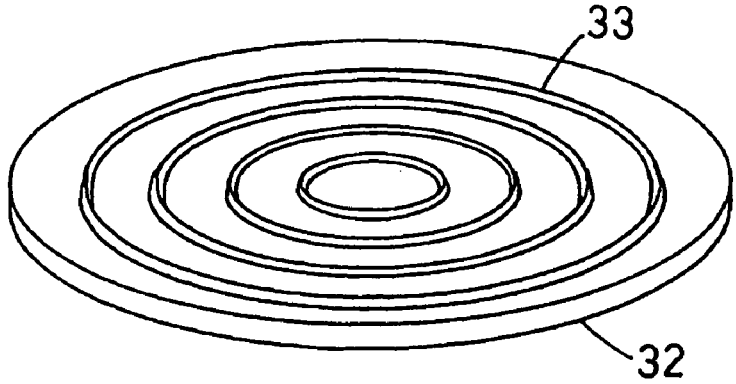
FIG. 19 is a perspective view of a reinforcement plate in which a number of annular protrusions are concentrically formed on the upper surface.

FIG. 19 shows a reinforcement plate 32 in which a number of annular protrusions 22 are concentrically formed on the upper surface.

Figure 20:
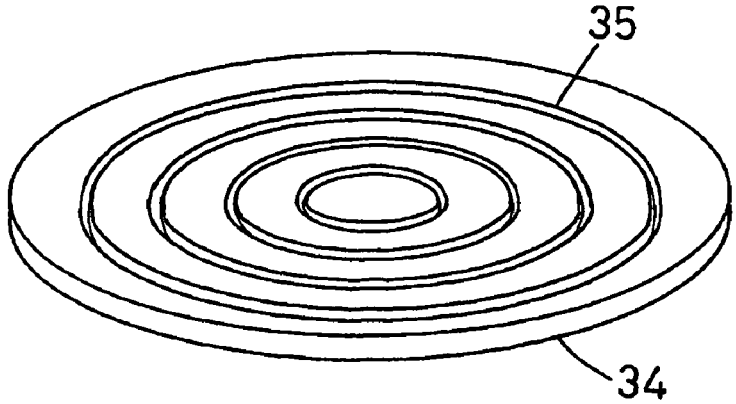
FIG. 20 is a perspective view of a reinforcement plate in which a number of annular grooves are concentrically formed on the upper surface.

FIG. 20 shows a reinforcement plate 34 in which a number of annular grooves 35 are concentrically formed on the upper surface.

Figure 21:
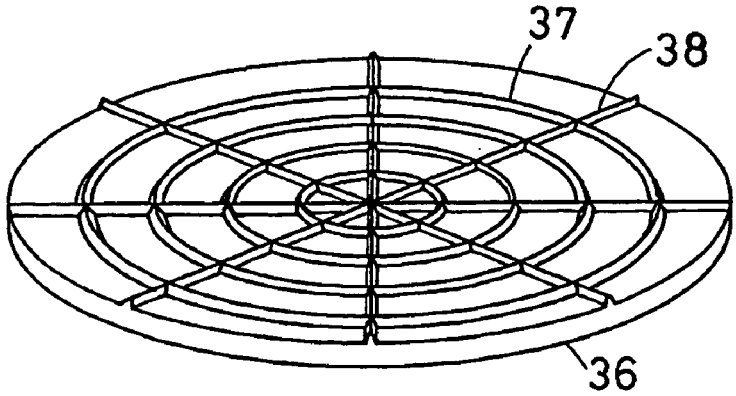
FIG. 21 is a perspective view of a reinforcement plate in which a number of annular and radial protrusions are formed on the upper surface.

FIG. 21 shows a reinforcement plate 36 in which a number of annular protrusions 37 and redial protrusions 38 are formed on the upper surface.

Figure 22:
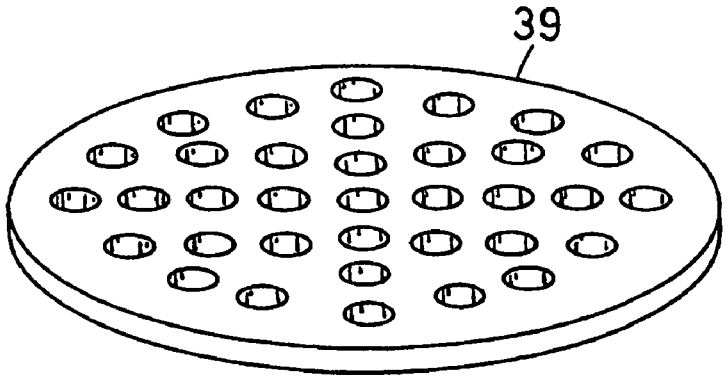
FIG. 22 is a perspective view of a porous reinforcement plate.

FIG. 22 shows a porous reinforcement plate 39.

Figure 23:
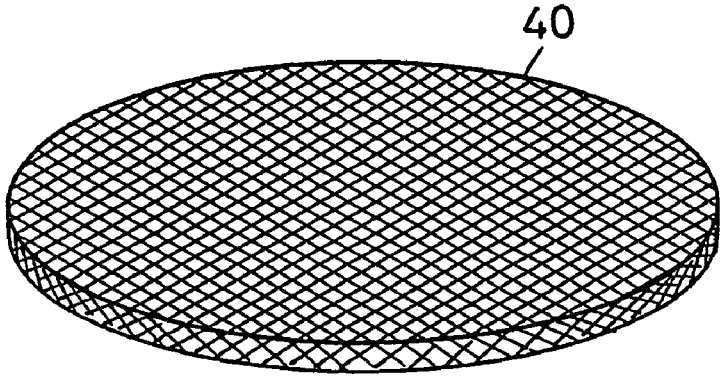
FIG. 23 is a perspective view of a mesh-like reinforcement plate.

FIG. 23 shows a reinforcement plate 40 that comprises a mesh plate made of metal or high-tensile resin.

Figure 24:
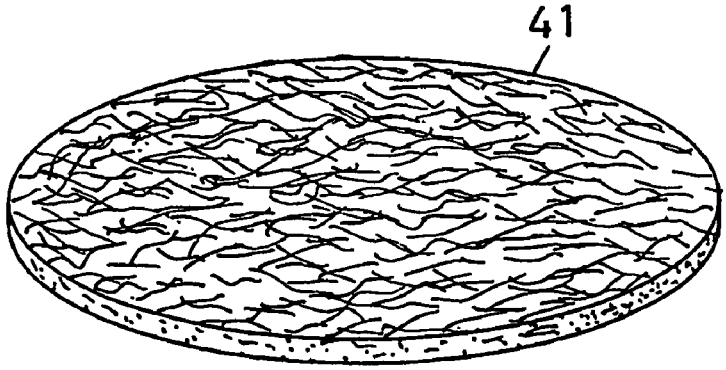
FIG. 24 is a perspective view of a fiber-containing reinforcement plate.
Figure 25:
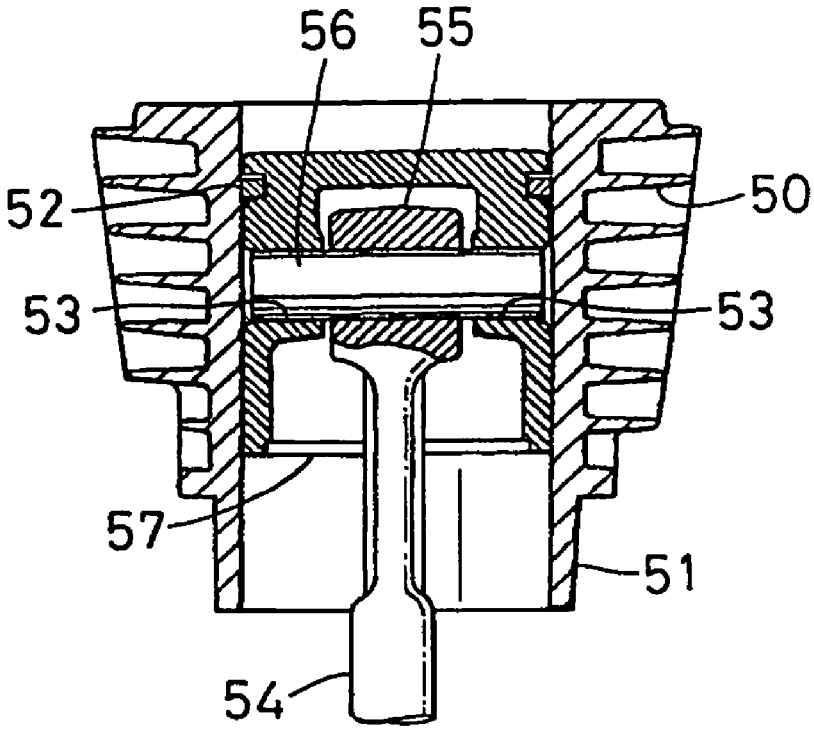
FIG. 25 is a vertical sectional front view of a known an oilless reciprocating fluid machine.

FIG. 24 shows a reinforcement plate 41 that contains metallic or high-tensile-resin fibers.

In the reinforcement plate in FIGS. 16. 18. 19. 20, 21, 22 and 24, the lower surface may have those on the upper surface.

Figure 26:
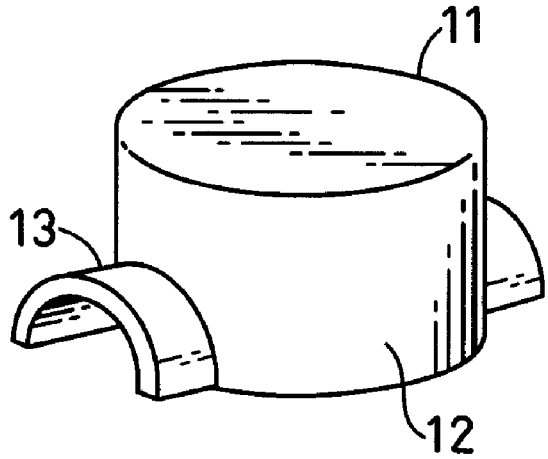
FIG. 26 is a perspective view of the cylindrical reinforcement in the fifth and twelfth embodiments (FIGS. 5 and 12, respectively), of an oilless reciprocating food machine according to the present invention.

FIG. 26 is a perspective view of the cylindrical reinforcement in the fifth and twelfth embodiments.

Figure 27:
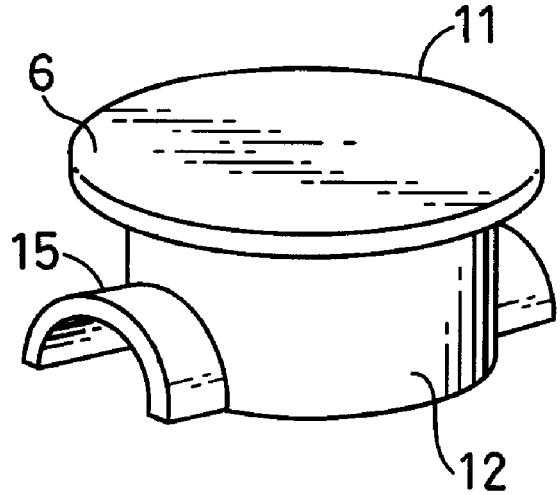
FIG. 27 is a perspective view of the cylindrical reinforcement in the seventh and fourteenth embodiments (FIGS. 7 and 14, respectively) of an oilless reciprocating food machine according to the present invention.

FIG. 27 is a perspective view of the cylindrical reinforcement in the seventh and fourteenth embodiments in FIGS. 7 and 14, respectively.

The foregoing merely relates to embodiments of the inventions. Various changes and modifications may be made by a person skilled in the art without departing from the scope of claims wherein:

What is claimed is:

1. An oilless reciprocating fluid machine comprising:

a piston made of self-lubricating and heat-resistant synthetic resin, comprising a top wall and a middle portion in which a pair of pin bores is formed;

a cylinder in which the piston is slidably fitted;

a connecting rod for reciprocating the piston; a piston pin that extends through an upper portion of the connecting rod and is fitted in the pair of the pin bores of the middle portion of the piston to reciprocally move the piston in the cylinder;

a cylindrical reinforcement in an upper half of the piston that has more strength than the piston; and a pair of semi cylindrical support portions extending horizontally from a lower portion of the cylindrical reinforcement to surround an upper half of the pair of pin bores.

2. An oilless reciprocating fluid machine as claimed in claim 1 wherein a circumferential portion extends outward horizontally from an upper end of the circumference of the top wall of the cylindrical reinforcement.

* * * * *